US010968708B2

(12) United States Patent
McGarian et al.

(10) Patent No.: US 10,968,708 B2
(45) Date of Patent: Apr. 6, 2021

(54) APPARATUS AND METHOD FOR RAISING COMPONENTS FROM A WELLBORE

(71) Applicant: McGarian TDC Limited, Portlethen (GB)

(72) Inventors: Bruce McGarian, Grampian (GB); Wayne Biart, Weston, CO (US)

(73) Assignee: McGarian TDC Limited, Portlethen (GB)

( * ) Notice: Subject to any disclaimer, the term of this patent is extended or adjusted under 35 U.S.C. 154(b) by 0 days.

(21) Appl. No.: 15/747,418

(22) PCT Filed: Jul. 25, 2016

(86) PCT No.: PCT/GB2016/052269

§ 371 (c)(1),
(2) Date: Jan. 24, 2018

(87) PCT Pub. No.: WO2017/021691

PCT Pub. Date: Feb. 9, 2017

(65) Prior Publication Data

US 2018/0371850 A1 Dec. 27, 2018

(30) Foreign Application Priority Data

Jul. 31, 2015 (GB) ..... 1513566

(51) Int. Cl.
*E21B 19/06* (2006.01)
*E21B 31/00* (2006.01)
(Continued)

(52) U.S. Cl.
CPC ..... *E21B 19/06* (2013.01); *E21B 19/07* (2013.01); *E21B 19/161* (2013.01); *E21B 31/005* (2013.01)

(58) Field of Classification Search
CPC ..... E21B 19/16; E21B 19/161; E21B 19/163; E21B 19/06; E21B 31/005; E21B 19/07
See application file for complete search history.

(56) References Cited

U.S. PATENT DOCUMENTS 3,961,399 A * 6/1976 Boyadjieff ..... E21B 19/10 188/67
9,038,712 B1 * 5/2015 Streety ..... E21B 19/07 166/55.2

(Continued)

FOREIGN PATENT DOCUMENTS

WO WO 2007/142535 A1 12/2007
WO WO 2014/066368 A2 5/2014
WO WO2015/017911 2/2015

OTHER PUBLICATIONS

Combined Search and Examination Report for GB1513566.8 (dated Feb. 15, 2016).

(Continued)

*Primary Examiner* — Christopher J Sebesta
(74) *Attorney, Agent, or Firm* — Klarquist Sparkman, LLP

(57) ABSTRACT

A lifting apparatus for lifting drill string components from a wellbore, the lifting apparatus comprising: upper and lower support elements, each of the support elements having a central aperture passing therethrough; a lifting arrangement which is operable to vary the distance between the upper and lower support elements between a first, relatively short distance and a second, relatively long distance; and selective gripping arrangements held or supported by the upper and lower support elements, respectively, each selective gripping arrangement being operable to apply a gripping force to the exterior of a substantially tubular element passing through the central apertures of the upper and lower support (Continued)

Figure 1:
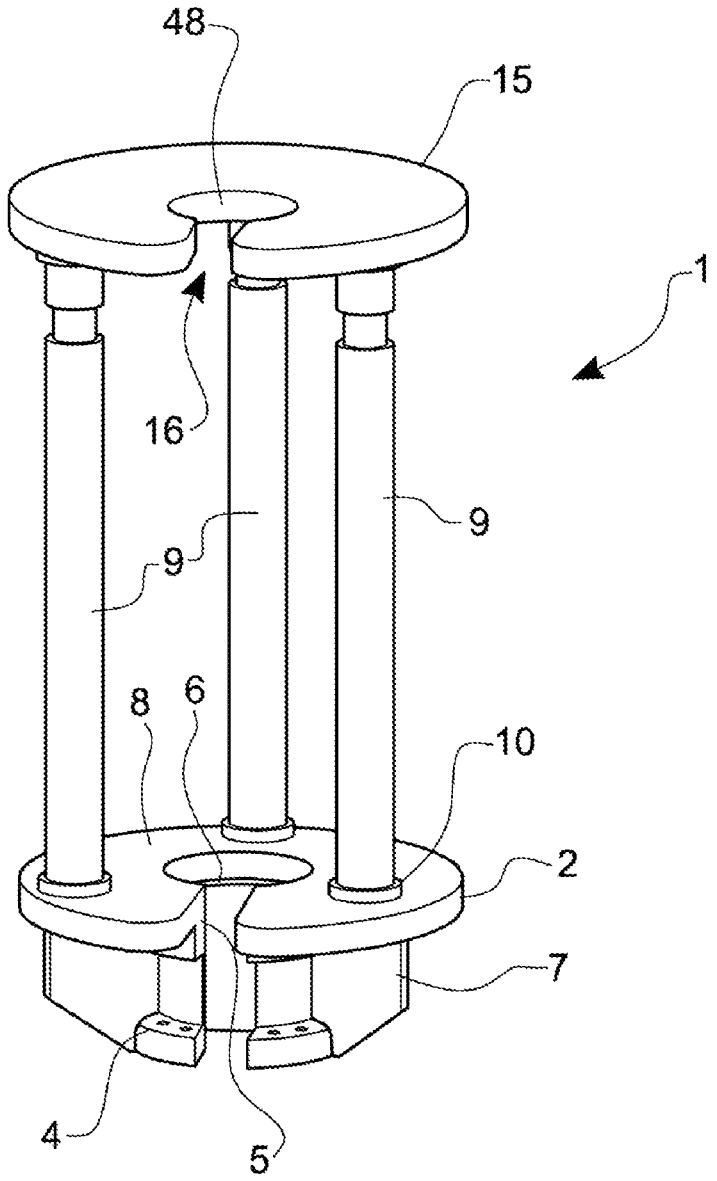

elements, wherein the selective gripping arrangements may be activated or deactivated independently of one another.

20 Claims, 7 Drawing Sheets

(51) Int. Cl.
*E21B 19/07* (2006.01)
*E21B 19/16* (2006.01)

(56) References Cited

U.S. PATENT DOCUMENTS

2003/0164071 A1* 9/2003 Moe ..... E21B 19/168 81/57.2
2005/0056122 A1* 3/2005 Belik ..... E21B 19/161 81/57.16
2006/0108122 A1* 5/2006 Buytaert ..... E21B 17/026 166/379
2006/0201669 A1* 9/2006 Sivley ..... E21B 19/16 166/77.51
2007/0074606 A1* 4/2007 Halse ..... E21B 19/164 81/57.16
2010/0101805 A1* 4/2010 Angelle ..... E21B 19/16 166/380
2012/0048535 A1 3/2012 Ruttley et al.
2012/0111155 A1* 5/2012 Holen ..... E21B 19/163 81/57.35
2013/0192427 A1* 8/2013 Aarhus ..... E21B 19/168 81/57.11
2014/0124218 A1 5/2014 Pilgrim
2015/0034297 A1* 2/2015 Tucken ..... E21B 19/00 166/77.1

OTHER PUBLICATIONS

International Search Report and Written Opinion for PCT/GB2016/052269, dated Jun. 12, 2016, 17 pages.

* cited by examiner

APPARATUS AND METHOD FOR RAISING COMPONENTS FROM A WELLBORE

CROSS-REFERENCE TO RELATED APPLICATIONS

This is the U.S. National Stage of International Application No. PCT/GB2016/052269, filed Jul. 25, 2016, which was published in English under PCT Article 21(2), which in turn claims the benefit of Great Britain Application No. 1513566.8, filed Jul. 31, 2015.

This application relates to apparatus and methods for removing components from a wellbore.

When drilling takes place in a wellbore, for instance during exploration for oil or natural gas, a drill head (possibly along with other components such as valves, MWD tools etc.) is lowered into the wellbore on a series of elongate support components, which are typically known as "tubulars". Each tubular may be, for example, around 20-40 ft in length. A large number of tubulars may be attached to one another (typically, by way of cooperating screw threads at their ends) to lower the drill head further into the wellbore. Drilling may take place at a depth of several thousand feet, and so a large number of tubulars may need to be strung together to allow the drill head to reach the required depth. Together, the tubulars, the drill head/drill bit and other components make up a drill string.

Once the drilling operation has been completed, or if the drill string needs to be retrieved for any other reason (for instance, because of a mechanical fault or excessive wear), it is necessary to raise the components of the drill string back up to the surface. This would usually be carried out with a drilling rig.

One known way of doing this is by using a lifting apparatus comprising upper and lower clamping arrangements, with a hydraulic lifting arrangement disposed between the upper and lower clamping arrangements. In use of the lifting arrangement, the upper clamping arrangement clamps around the outer surface of a tubular, while the lower clamping arrangement is released. The lifting arrangement then lifts the upper clamping arrangement upwards with respect to the lower clamping arrangement. Once the upper clamping arrangement has been raised to its maximum height (or the maximum practical height in the circumstances), the lower clamping arrangement is activated to clamp around the exterior of the tubular. The upper clamping arrangement is then released. The lifting arrangement is then lowered, so that the upper clamping arrangement drops downwardly to its starting position. The upper clamping arrangement is then once again clamped around the tubular, while the lower clamping arrangement is released. The lifting arrangement may then once again lift the upper clamping arrangement, thereby lifting the tubular again, and so on.

In this way it will be understood that the drill string may be lifted upwardly in a series of repeated lifting steps. Once a tubular forming part of the drill string has been lifted entirely out of the wellbore so that it is above the upper clamping arrangement, the tubular may be unscrewed from the tubular immediately below it and removed. The lifting operation then continues.

This type of lifting apparatus is sometimes known as a "jacking" device, and known devices of this type are manufactured, for example, by Casinjac, Inc.

It is an object of the present invention to provide an improved device of this type.

Accordingly, one aspect of the present invention provides a lifting apparatus for lifting drill string components from a wellbore, the lifting apparatus comprising: upper and lower support elements, each of the support elements having a central aperture passing therethrough; a lifting arrangement which is operable to vary the distance between the upper and lower support elements between a first, relatively short distance and a second, relatively long distance; and selective gripping arrangements held or supported by the upper and lower support elements, respectively, each selective gripping arrangement being operable to apply a gripping force to the exterior of a substantially tubular element passing through the central apertures of the upper and lower support elements, wherein the selective gripping arrangements may be activated or deactivated independently of one another, wherein the upper and lower support elements each have an inner surface defining the central aperture, and an outer surface, and a slot passing through the entire depth of the element and providing communication between the inner surface and the outer surface, and wherein the central apertures of the upper and lower support elements are at least partially aligned with another, and the slots of the upper and lower support elements are at least partially aligned with one another.

Advantageously, the lifting arrangement is a hydraulic lifting arrangement.

Preferably, the lifting arrangement comprises one or more hydraulic cylinders.

Conveniently, the lifting arrangement comprises three hydraulic cylinders which are substantially evenly radially spaced around the central apertures of the upper and lower support elements.

Advantageously, the slots of the upper and lower support elements are located substantially mid-way between two of the hydraulic cylinders.

Preferably, the lifting arrangement comprises an arcuate hydraulic lifting arrangement, comprising an arcuate piston slideably mounted within an arcuate barrel.

Conveniently, the arcuate lifting arrangement extends more than 180° around the central apertures of the upper and lower support elements.

Advantageously, the lifting apparatus further comprises a resonator which is mounted on or attached to the upper support element.

Preferably, the resonator has a central aperture formed therethrough, which allows a tubular element to pass entirely through the resonator.

Conveniently, the central aperture of the resonator is substantially aligned with the central apertures of the upper and lower support elements, so that a tubular element may pass through the central apertures of the upper and lower support elements and of the resonator.

Advantageously, the resonator has a slot formed therein passing from the central aperture of the resonator to a side wall thereof, allowing a tubular element passing through the central aperture of the resonator to be removed from the resonator entirely through the slot.

Preferably, the resonator is operable to apply vibrational forces acting substantially in a direction passing from the upper support element to the lower support element.

Conveniently, the frequency of the vibrational force is exerted by the resonator may be varied.

Advantageously, the resonator includes first and second shafts which may be driven to rotate in opposite directions, the first and second shafts each having off-centre masses mounted thereon.

Preferably, the first and second shafts are disposed on either side of the central aperture of the resonator.

Conveniently, the lifting apparatus further comprises a rotation arrangement disposed between the upper support element and the gripping arrangement that is held or supported by the upper support element, so that the gripping arrangement is able to rotate with respect to the upper support element.

Advantageously, the gripping arrangement may rotate with respect to the upper support element around an axis that is substantially perpendicular to the plane of the upper support element.

Preferably, the lifting arrangement comprises a rotation arrangement positioned between the gripping arrangement and the upper support element to allow rotation of the gripping arrangement with respect to the upper support element, and wherein the rotation arrangement has a gap formed therein so that a tubular element passing through the upper support element and the gripping arrangement may be removed from the lifting arrangement in a direction which is substantially parallel with the plane of the upper support element, and pass through the gap formed in the rotation arrangement as it is removed.

Conveniently, the lifting apparatus further comprises a rotation arrangement disposed between the lower support element and the gripping arrangement that is held or supported by the lower support element, so that the gripping arrangement is able to rotate with respect to the lower support element.

Advantageously, the gripping arrangement may rotate with respect to the lower support element around an axis that is substantially perpendicular to the plane of the lower support element.

Preferably, the lifting arrangement comprises a rotation arrangement positioned between the gripping arrangement and the lower support element to allow rotation of the gripping arrangement with respect to the lower support element, and wherein the rotation arrangement has a gap formed therein so that a tubular element passing through the lower support element and the gripping arrangement may be removed from the lifting arrangement in a direction which is substantially parallel with the plane of the lower support element, and pass through the gap formed in the rotation arrangement as it is removed.

Conveniently, the rotation arrangement comprises a bearing.

Advantageously, the rotation arrangement is located between the resonator and the gripping arrangement.

Another aspect of the present invention provides a method comprising: providing a lifting apparatus according to any preceding claim; passing a substantially tubular element through the central apertures of the upper and lower support elements, so that the substantially tubular element extends continuously through the central apertures of the upper and lower support elements; and removing the substantially tubular element from the lifting apparatus in a generally lateral direction by passing the substantially tubular element through the slots of the upper and lower support elements so that the substantially tubular element is entirely removed from the lifting apparatus.

A further aspect of the present invention provides a method comprising:

providing a lifting apparatus according to any one of the above; Installing the lifting apparatus around a substantially tubular element by moving the lifting apparatus towards the substantially tubular element in a generally lateral direction, so that the substantially tubular element passes through the slots of the upper and lower support elements, with the result that the substantially tubular element passes through the central apertures of the upper and lower support elements Another aspect of the present invention provides a method comprising: providing a lifting apparatus according to any one of the above; passing a substantially tubular element through the central apertures of the upper and lower support elements, so that the substantially tubular element extends continuously through the central apertures of the upper and lower support elements; gripping the substantially tubular element with one or both of the gripping arrangements; and operating the lifting arrangement to apply a force to the substantially tubular element in a direction substantially parallel with the longitudinal axis of the substantially tubular element.

A further aspect of the present invention provides a method comprising: providing a lifting apparatus according to any one of claims 16 to 20; passing a substantially tubular element through the central aperture of the upper support element; gripping the substantially tubular element using the gripping element that is held or supported by the lower or upper support element; and rotating the substantially tubular element, by way of the rotation arrangement, with respect to the upper and lower support elements, about an axis which is substantially parallel with the longitudinal axis of the substantially tubular element.

Figure 2:
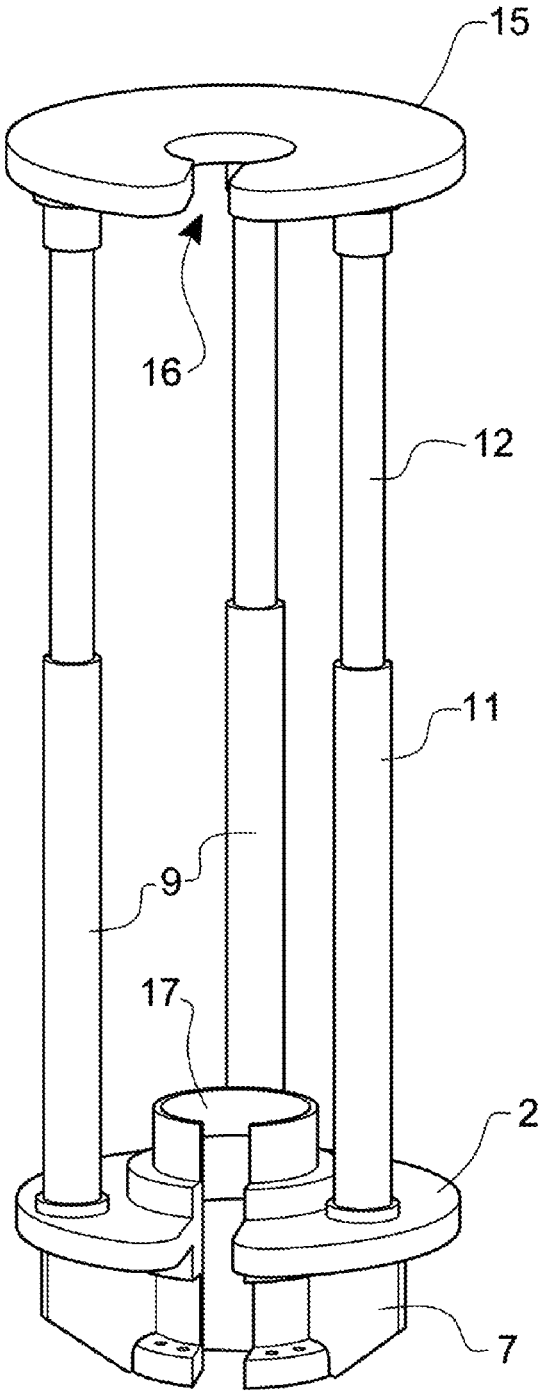
Figure 3A:
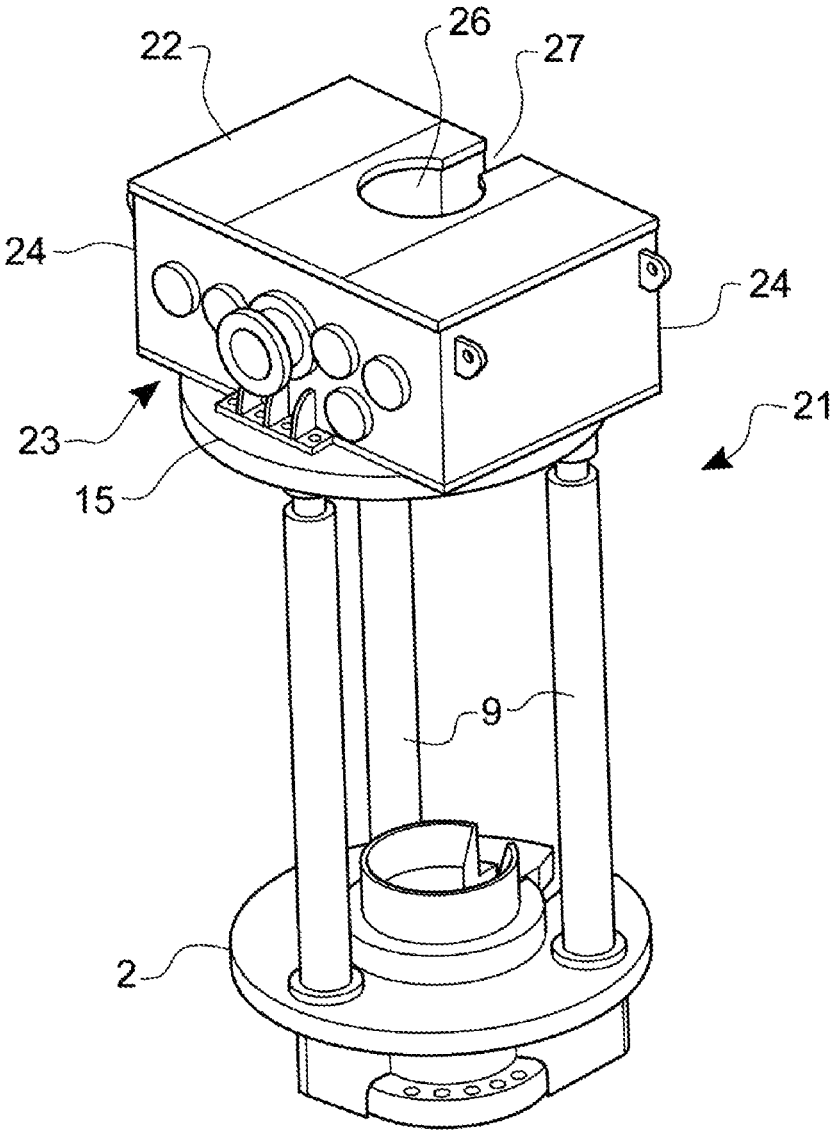
Figure 3B:
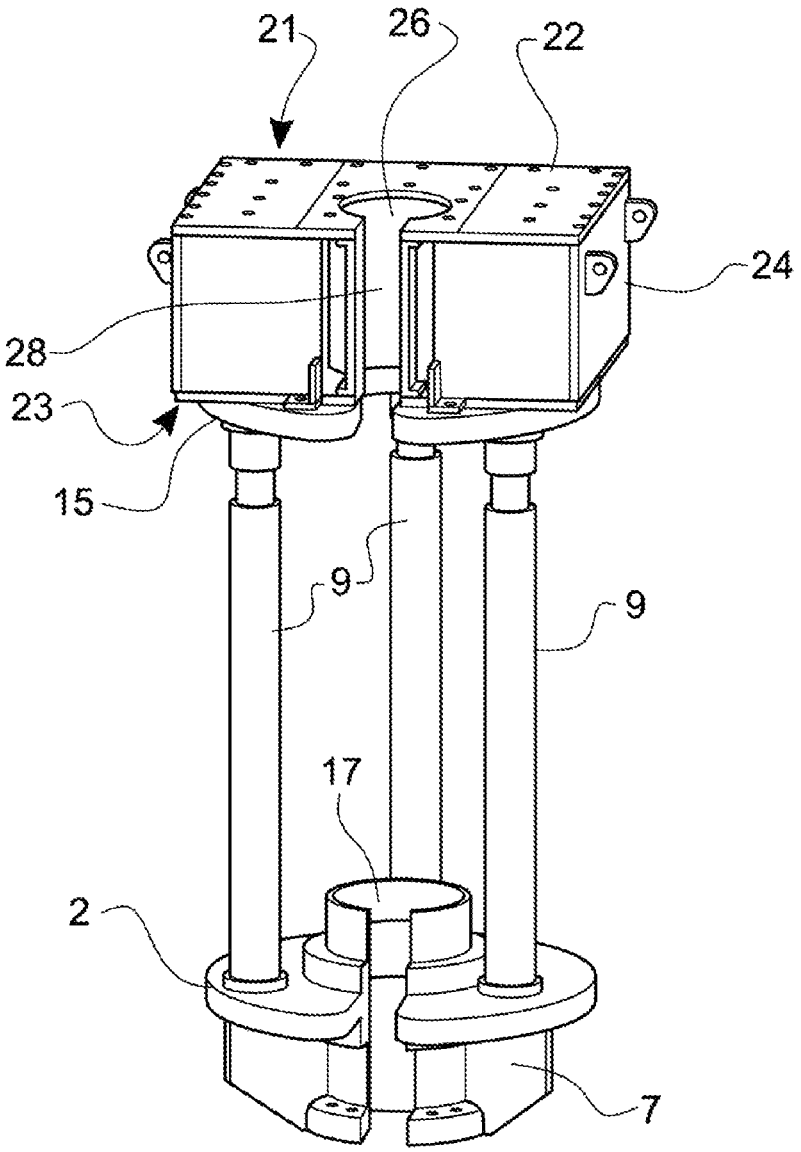
Figure 4:
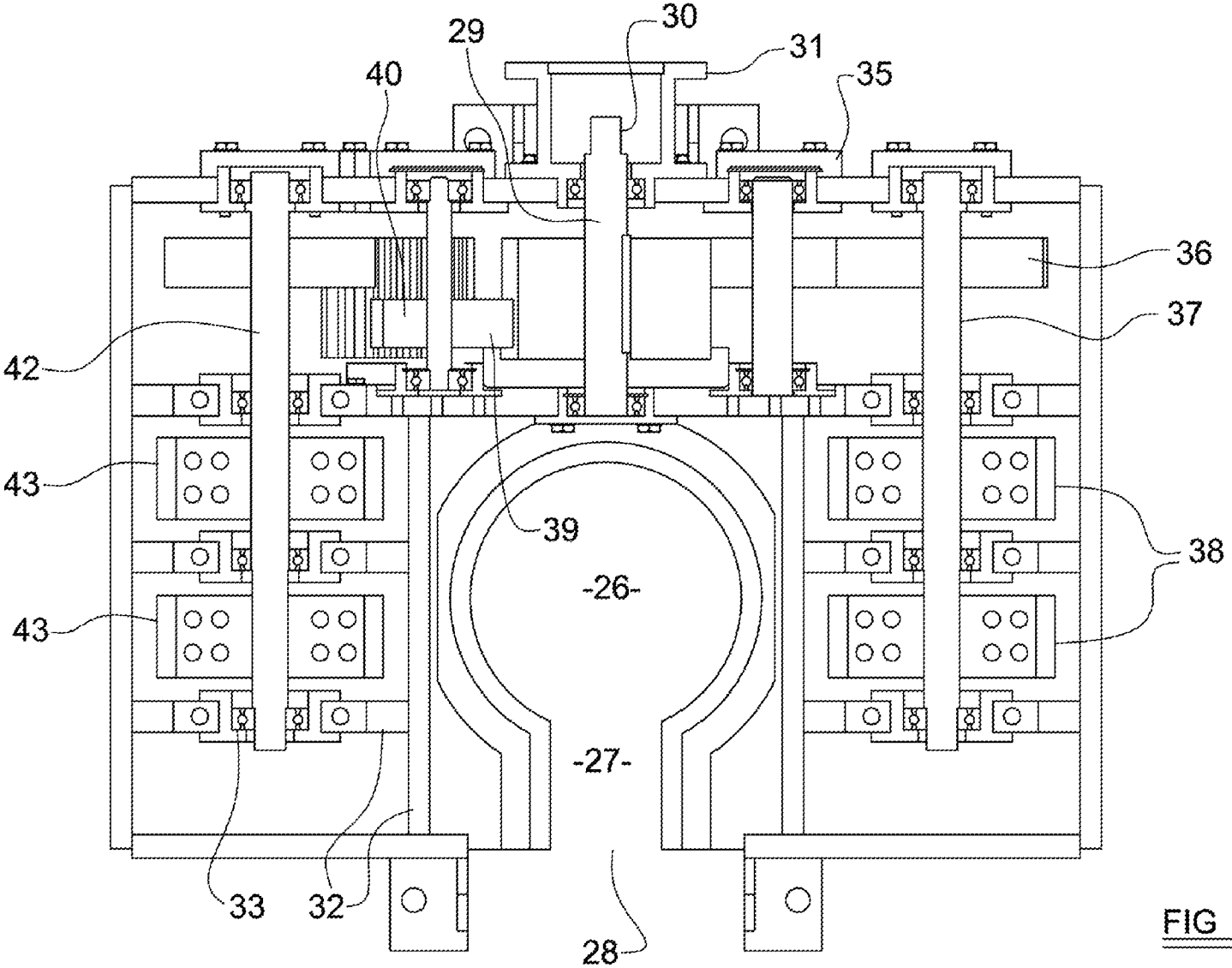
Figure 5:
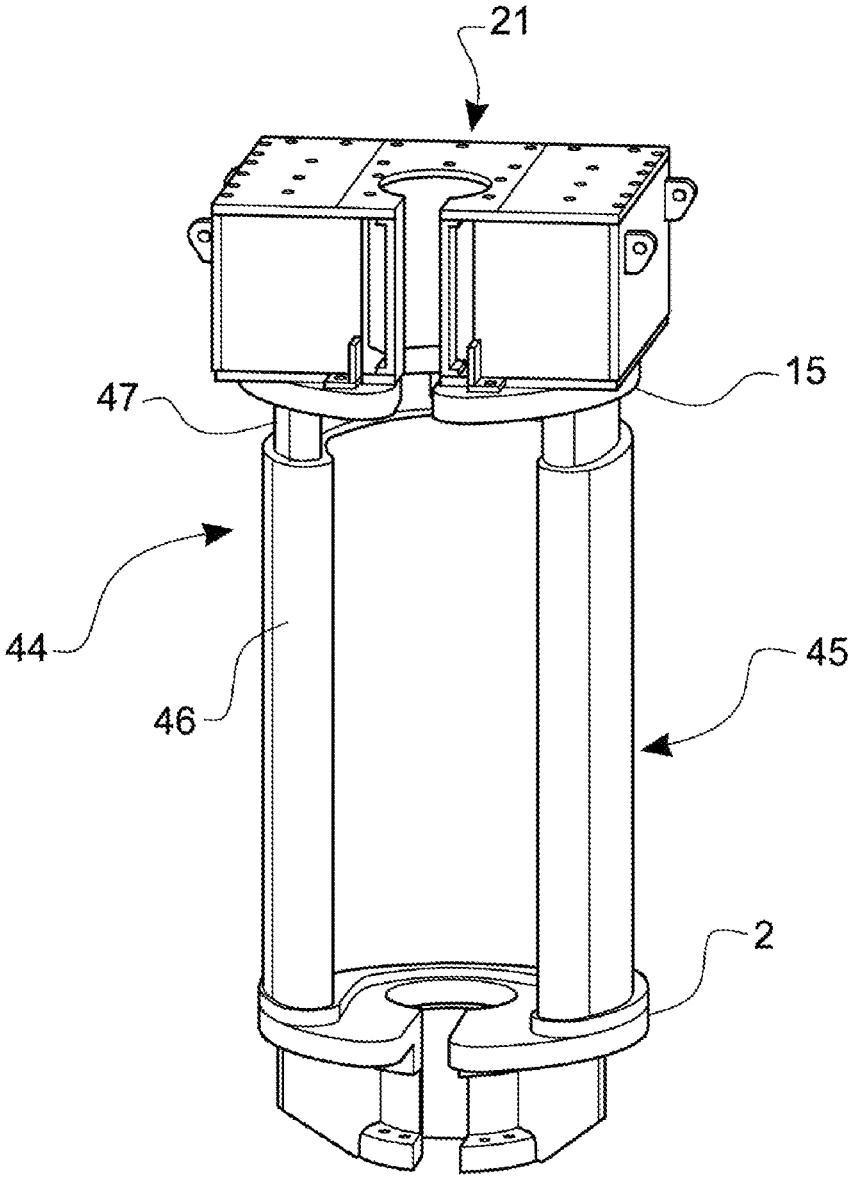
Figure 6:
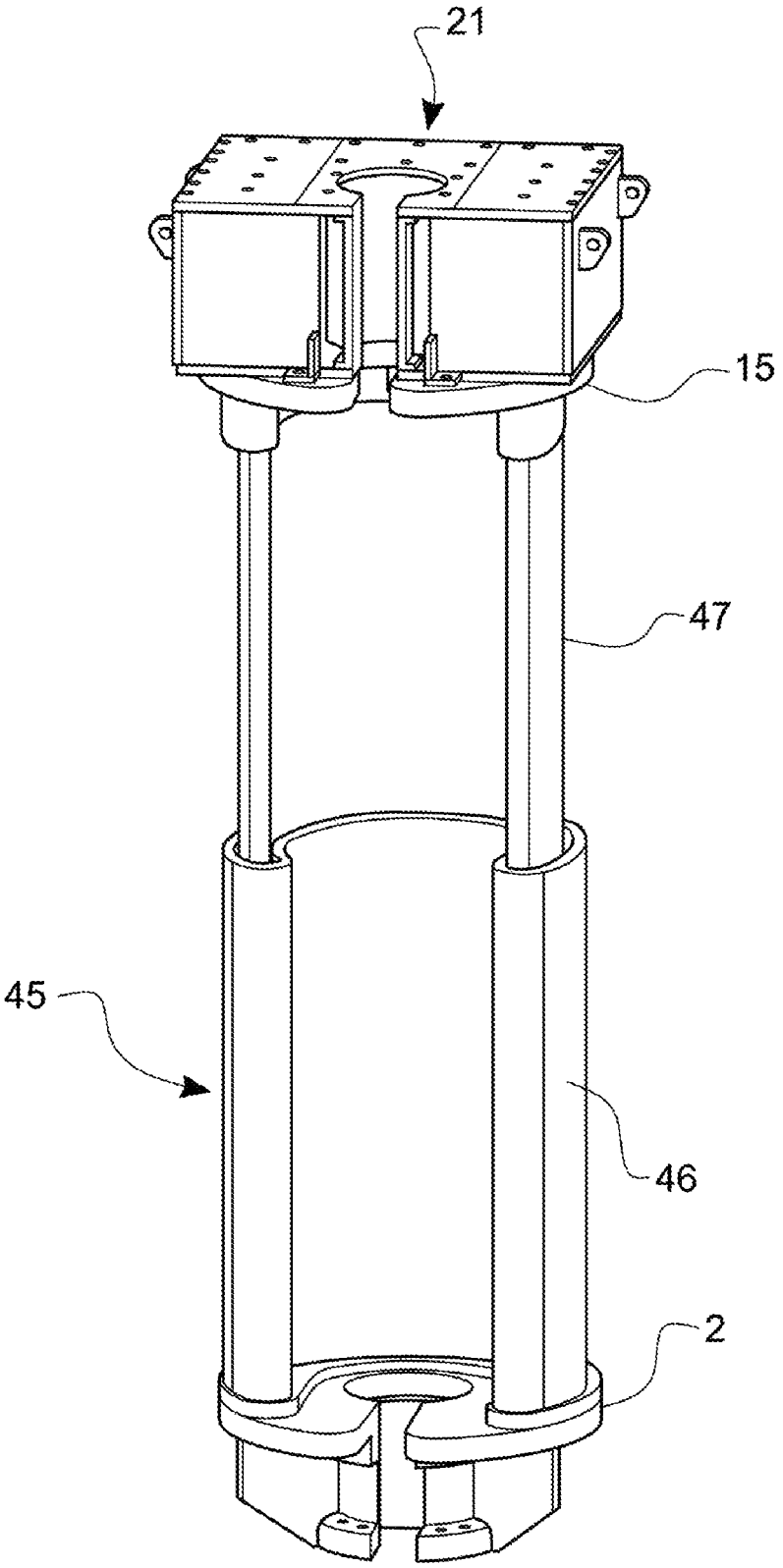

In order that the invention may be more readily understood, embodiments will now be described, by way of example, with reference to the accompanying drawings, in which:

FIGS. 1 and 2 show a first lifting apparatus embodying the present invention;

FIGS. 3*a*, 3*b* and 4 show a second lifting apparatus embodying the present invention; and FIGS. 5 and 6 show a third lifting apparatus embodying the present invention.

With reference firstly to FIG. 1, a first lifting apparatus 1 is shown.

The first lifting apparatus 1 comprises a lower support plate 2, which in the embodiment shown takes the form of an annular plate having a generally circular outer diameter 3, and also a generally circular central aperture 6, having a substantially circular inner diameter 4. The central aperture 6 may be centrally disposed in the lower support plate 2. The lower support plate 2 preferably has a substantially constant thickness.

The lower support plate 2 has a radial gap 5 formed therein, comprising a break in the plate, passing through the entire depth of the plate and extending from the outer diameter 3 to the inner diameter 4. In preferred embodiments, the width of the gap 5 is constant or substantially constant along all or some of its length as it passes from the outer diameter 3 to the inner diameter 4. In the embodiment shown the outer edges of the gap 5 (i.e. where the gap 5 meets the outer diameter) has rounded edges.

Also, in preferred embodiments the width of the gap 5 is less than the diameter 4 of the inner aperture 6. In some embodiments the width of the gap 5 may be around $1/3^{rd}$ of the diameter 4 of the inner aperture 6, although the width of the gap 5 maybe more or less than this in other embodiments. Merely as an example, the lifting apparatus may be sized to accommodate tubular elements having external diameters of around 2 and ⅜ inches (6.03 cm) to 8 and ⅝ inches (21.91 cm).

In the embodiment shown, the lower support plate 2 is provided on a mounting unit 7, which allows the lower support plate 2 to be attached to a suitable component at the surface of the wellbore. The lower support plate 2 may, for instance, be positioned on top of a wellhead or blow out preventer (BOP), and the shape of the mounting unit 7 may be selected to allow easy and/or convenient mounting. In preferred embodiments, as shown in FIG. 1, the mounting unit 7 also has a break or gap formed therein which is fully, or at least partially, aligned with the gap 5 in the lower support plate 2 so that, when viewed at right angles to the plane of the lower support plate 2, the mounting unit 7 does not substantially obstruct or occlude any part of the gap 5.

Mounted on an upper surface 8 of the lower support plate 2 are three hydraulic cylinders 9. The hydraulic cylinders 9 preferably extend at right angles from the plane of the lower support plate 2.

The hydraulic cylinders 9 may be attached to the upper surface 8 of the lower support plate 2 by any suitable means, for instance by a series of bolts or screws which pass through a flange 10 at the bottom of each hydraulic cylinder 9, and are received in suitable apertures (not shown) formed in the lower support plate 2.

The hydraulic cylinders 9 are preferably evenly spaced radially around the lower support plate 2, there being 120° radially between each of the hydraulic cylinders 9. However, other spacings may be used. For instance, the two cylinders 9 on either side of the gap 5 may have a larger gap between them than the other gaps between the cylinders 9. In one example, the cylinders 9 on either side of the gap 5 may be radially separated from each other by 125°, with radial gaps of 117.5° between each of these cylinders 9 and the remaining cylinder. A spacing of this kind will allow more space for access to a tubular held by the lifting apparatus 1, and this is discussed in greater detail below.

Preferably, one of the cylinders 9 is substantially directly opposite the gap 5, as shown in FIG. 1. In conjunction with this, or separately, the gap 5 itself may be substantially midway between the other two cylinders 9.

In this embodiment the hydraulic cylinders 9 comprise, as is known in the art, an outer barrel 11, with an inner piston 12 mounted for longitudinal movement within the barrel 11. A supply arrangement for supplying hydraulic fluid to the cylinders 9 will be provided, but this is not shown in the figures. The skilled reader will be aware of how this may be achieved, however.

Mounted on each cylinder head 13 is a mounting arrangement 14, which in this embodiment comprises a radially extending flange. Mounted on the cylinder heads 13 of the three hydraulic cylinders 9 is an upper support plate 15. The upper support plate 15 is, in this embodiment, generally identical to the lower support plate 2 in shape and dimensions. As with the lower support plate 2, the upper support plate 15 has a central aperture 48 formed therethrough, and has a gap 16 formed in its perimeter. In preferred embodiments, the central apertures 48, 6 and the gaps 5, 16 in the upper and lower support plates 2, 15 are aligned or substantially aligned with one another, when the lifting apparatus 1 is viewed in a direction which is at right angles to the planes of the lower and upper support plates 2, 15.

When pressurised hydraulic fluid is supplied to the cylinders 9, the pistons 12 thereof are driven upwardly, to increase the distance between the lower and upper support plates 2, 15, as shown in FIG. 2.

In FIG. 2, a lower clamping arrangement is shown positioned in the inner aperture 6 of the lower mounting plate 2 (this is omitted from FIG. 1 for the purposes of clarity. In this embodiment, the lower clamping arrangement takes the form of a tapered bowl 17, shown schematically in the figures, which is narrower at its bottom end than at the top end, with gripping elements or "slips" (not shown) being provided on the interior of the bowl to grip the outer surface of a tubular passing therethrough. In preferred embodiments a powered element known as a "spider" 17 is provided as the lower clamping arrangement. As is known in the art, a spider may pass around a tubular element, and has slips provided within the spider which can selectively grip the tubular. Hydraulic fluid (or another source of power) may be supplied to the spider to control whether the spider is in a "closed" position, in which it will apply a clamping force to a tubular passing through the spider, or whether it is in an "open" position in which the spider will not grip the tubular passing therethrough. Most spiders do not default to the open or closed position, but in preferred embodiments, for safety reasons, the default state is for the spider to be in the closed position, so that if there is a failure of hydraulic fluid a tubular passing through the spider will be gripped and will not fall downwards under the influence of gravity unintentionally. Hydraulic fluid therefore needs to be provided to the spider to move the spider from the closed position to the open position. However, in other embodiments, the default state of the spider may be the open position, with the supply of fluid being required to move the spider into the closed position to grip a tubular.

Similarly, an upper clamping arrangement (not shown in FIGS. 1 and 2) is provided in the inner aperture of the upper support plate 15, and in preferred embodiments this once again comprises a spider which may be similar or identical to the spider provided in the lower support plate 2.

Use of the first lifting apparatus 1 will now be described.

Operations may take place at a depth of several thousand feet, and so a large number of tubulars may need to be strung together to gain access to production or injection zones. Together, the tubulars, the drill head/drill bit and other components make up a drill string, the tubulars and bottom hole assembly (BHA) in a remedial operation make up a work string. The tubulars and production BHA (packers, control lines, sliding sleeves, and pumps) make up a completion string. The description below mainly refers to drill strings, but it should be understood that this is not intended to be limiting and the invention can be used in conjunction with any type of operation.

Once the drilling operation has been completed, or if the drill string needs to be retrieved for any other reason (for instance, because of a mechanical fault or excessive wear), it is necessary to raise the components of the drill string back up to the surface. This would usually be carried out with a drilling rig.

In remedial and completion scenarios the process is similar with the operations being carried out by a drilling rig or workover rig. Alternatively the operations can be carried out by a coil tubing unit or a snubbing unit and these operations are often referred to as rigless operations.

As discussed above, the lifting apparatus 1 may be provided on a wellhead or other component at the surface of a wellbore. A tubular (not shown) protrudes upwardly from the wellbore, and through the lower and upper spiders so that the upper free end of the tubular protrudes upwardly above the upper spider and is in free space.

The upper spider is placed in the closed position, so that it grips an outer surface of the tubular, and the lower spider is placed in the open position. The hydraulic cylinders 9 are initially in a collapsed, relatively short state, as shown in FIG. 1.

Fluid is then supplied to the cylinders 9 so that the pistons 12 thereof rise upwardly. It will be understood that this will increase the distance between the upper support plate 15 and the lower support plate 2, and the tubular will be lifted upwardly along with the upper support plate 15.

Once the pistons 12 of the cylinders 9 have moved upwardly by the desired amount (which may be the full stroke of each cylinder 9, or may be less than this if there is an obstruction or other reason why the full stroke cannot be used), this motion is halted. The lifting arrangement 1 is shown in this extended state in FIG. 2. The lower spider is then placed in the closed position, so that it grips the outer surface of the tubular. After this, the upper spider is placed in the open position, so that it no longer grips the outer surface of the tubular.

Pressurised fluid is then removed from the hydraulic cylinders 9, so that the pistons 12 fall, or are drawn, back into the barrels 11 of the cylinders 9. The upper support plate 15 will therefore fall downwardly towards the lower support plate 2. As it does so, the tubular will remain fixed in placed, as it is clamped by the lower spider. When the hydraulic cylinders 9 are once again in their fully collapsed position, (i.e. as shown in FIG. 1) the upper spider is placed in the closed position, and the lower spider is then placed in the open position. It will be understood that the first lifting arrangement 1 is now back in the start position, and this cycle of events may be repeated. In this way, the tubular is progressively lifted up with respect to the lifting arrangement 1, through a cycle of being gripped and released by the upper spider as it is lifted upwardly by the hydraulic cylinders 9.

This sequence of events may be controlled manually, or may be fully or partly automated. In preferred embodiments, both the opening and closing of the upper and lower spider and the raising and lowering of the hydraulic cylinders 9, is controlled using pressurised fluid. A single controller may therefore control the supply of fluid for all of these components, although the pressurised fluid to the various components may come from different sources (e.g. the pressurised fluid that is supplied to upper and lower spiders may be from a different source from the pressurised fluid that is supplied to the hydraulic cylinders 9).

If the control of the process is manual, there may be one or more safety interlocks, for instance to ensure that at least one of the spiders must be in the closed position at any time, and both spiders cannot be opened simultaneously to allow the tubular to fall downwardly under the influence of gravity.

If the process is fully automated, the sequence of opening and closing the upper and lower spiders and the raising and lowering of the hydraulic cylinders 9 may be controlled in a time sequence that allows for consistent and efficient raising of a tubular.

As discussed above, once a tubular has been lifted entirely out of the wellbore so that its lower end is above the upper spider, the tubular may be unscrewed from the component immediately below it (which will be gripped by one or both of the spiders) and removed. The process then continues, to raise further tubulars or other components from the wellbore.

The overall principles of the lifting or jacking sequence described above are known in the art.

As discussed above, both the upper and lower support plates 15, 2 have gaps 16, 5 formed in their perimeters, allowing communication between the central aperture 48, 6 of each support plate 15, 2 and the exterior of the support plate 15, 2 in a lateral direction, i.e. parallel with the plane of the support plate.

One advantage of this relates to the raising of tubulars which have cables or similar elements running along one side thereof. Many modern drilling or completion systems have cables which carry control signals and other information between the surface and components which form part of the drill string. For instance, tubulars may have cables such as small-diameter hydraulic cables, electric cables or fibre optic cables running down one side thereof. These cables may be rubber coated and clad, to increase the robustness of the cables, and also to prevent dissipation of the signal carried by the cable.

It is known for these cables to be fixed to the outside of a tubular by a clamp. One known kind of clamp includes a pair of rings that are fitted around the tubular at spaced-apart locations, with metal strips/centralisers extending between the clamps and protecting the cables. Each of the rings can be released from the tubular, for instance by knocking out one or more tapering retaining pins. Once both rings have been released, the clamp (and hence the cables themselves) can be removed.

In use of the first lifting apparatus 1, it is envisaged that a tubular will be raised until a clamp is between the upper and lower support plates 15, 2, and can be accessed by an operator through the space between the hydraulic cylinders 9 that are positioned on either side of the gaps 16, 5 formed in the support plates 15, 2. Once the clamp has been removed, the cables can be stripped away from the side of the tubular. The lower spider is of the kind that has a door or hatch on its front side (such as the Model F Cavins Advanced Spider), and the door or hatch can be opened (when the tubular is supported by the upper spider), and the cables can be removed from the side of the tubular through this door or hatch, and then through the gap 5 formed in the lower support plate 2. The door or hatch can then be closed again. As the lifting operation continues, this will allow cables to be removed effectively and conveniently from the side surfaces of tubulars that are being lifted.

If the gap 5 was not formed in the lower support plate 2, it would not be possible to remove cables in this way, and cables would need to be removed from tubulars as they emerge from the wellbore, before they pass through the lower support plate 2, and the limited space available is likely to make this difficult and/or inconvenient.

Another advantage of the gaps 5, 16 formed in the lower and upper support plates 2, 15 is that the first lifting apparatus 1 can be attached to, and removed from, a tubular laterally, i.e. from the side of the tubular. This is not the case with conventional lifting apparatuses, which completely surround the tubular and can only be attached to, or removed from, the tubular by being threaded/stripped over a free end of the tubular.

For instance, if the lifting apparatus 1 shown in FIGS. 1 and 2 is performing a series of lifting manoeuvres as discussed above, and it becomes necessary to remove the lifting apparatus 1 quickly, it can be removed in the following way.

Firstly, the tubular must be clamped, or otherwise held in place by another component. The skilled person will appreciate how this may be achieved. For instance, a drilling rig is likely to be positioned above the lifting device 1, which may include rig blocks or the like, including link arms from which the drill string can be suspended to hold it in place. Alternatively, if the lifting apparatus 1 is placed on a wellbore which includes a BOP, the BOP may include a clamping arrangement which can hold the tubular in place, although this is less preferred.

Once the tubular is held in place, both spiders can be placed in the open position, and can then be opened (i.e.

entirely opened around a hinge or the like, as will be understood by the skilled reader) and removed from the tubular.

The lifting apparatus 1 can then simply be removed laterally from the tubular, so that the tubular passes through the gaps 5, 16 formed in the lower and upper support plates 2, 15. Of course, for this to be possible, the external diameter of the tubular must be no greater than the width of the gaps 5, 16.

It will be understood that this is significantly easier than is the case with conventional lifting apparatuses. When using such apparatuses, it is usually necessary to lift the lifting apparatus upwardly over the free end of the tubular, which may be 10 ft or more above the level of the upper support plate 15. The mass of a lifting apparatus of this type might be around 4-7 tonnes, and so this is likely to be a difficult lifting operation. Alternatively, the operators may need to allow the tubular to drop downwardly so that the upper free end of the tubular is completely below the lifting apparatus, so that the lifting apparatus can be removed laterally, although if this was done the tubular would still need to be supported by another component of the system.

A further advantage conferred by the presence of the gaps 5, 16 is that, during a lifting operation, a tubular or other component can be removed from the lifting apparatus 1 without the need for the tubular to be lifted completely above the upper support plate 15. Once the tubular has reached the stage where its connection to the next-lowest component is clearly above the lower support plate 2, the bottom spider can be placed in the closed position, and the top spider can be placed in the open position. The tubular can then be removed from the next-lowest component (e.g. by unscrewing it), and removed laterally from the lifting apparatus 1, passing through the gap 16 formed in the upper support plate 15. The tubular that is removed therefore does not need to be lifted up through such a great height, and can be removed at a lower height, which is likely to be easier and more convenient than removing the tubular from a location above the entire lifting apparatus 1.

The skilled reader will therefore appreciate that the provision of the gaps in the lower and upper support plates 2, 15 confers significant advantages.

Referring to FIGS. 3*a* and 3*b*, a second lifting apparatus 20 is shown. In common with the first lifting apparatus 1 described above, the second lifting apparatus 20 has lower and upper support plates 2, 15, which are separated by three equally-spaced hydraulic cylinders 9. The lower and upper support plates 2, 15 have gaps 5, 16 formed therein, as above, and a lower spider 17 is provided in the inner aperture 6 of the lower support plate 2.

In contrast to the first lifting arrangement 1, the second lifting arrangement 20 includes a resonator 21 which, in this embodiment, is mounted on the upper surface of the top support plate 15.

In the example shown in FIGS. 3*a* and 3*b*, the resonator 21 includes a generally oblong casing, having a top wall 22 and a bottom wall 23, which are generally parallel with one another, and four side walls 24 which extend between the upper and lower walls 22, 23, and are generally perpendicular thereto. Overall, the resonator 21 generally takes the form of an oblong box.

Apertures 26 are formed through the top and bottom walls 22, 23. These apertures 26 generally match the size and shape of the central apertures 6, 48 formed through the lower and upper support plates 2, 15. When the resonator 21 is correctly placed on top of the upper support plate 15, these apertures 26 are aligned or substantially aligned with the inner apertures 6, 48 formed in the lower and upper support plates 2, 15.

The upper and lower walls 22, 23 of the resonator 21 also have respective slots 27 formed therethrough which extend between the apertures 26 and one of the side walls 24. Once again, these slots 27 are aligned with the gaps 5, 16 formed in the perimeters of the lower and upper support plates 2, 15.

Finally, the side wall 24 to which the slots 27 extend has an opening 28, aligned with the slots 27, extending between the top and bottom walls 22, 23 of the resonator 21. This opening can be seen most clearly in FIG. 3*b*.

Overall, it will be understood that the resonator 21 effectively has a cut-out section, so that it is does not interfere with the normal operation of the lifting arrangement 20. In particular, a tubular passing through the inner apertures 6, 48 in the lower and upper support plates 2, 15 will also pass through the aperture 26 formed in the casing of the resonator 21. In addition, if a tubular passing through the lifting apparatus 20 is removed laterally from the lifting arrangement 20 through the gaps 5, 16 formed in the lower and upper support plates 2, 15, the tubular will also pass through the slots 27 and the opening 28 formed in the casing of the resonator 21.

In preferred embodiments the upper spider is provided on or near the aperture 26 formed in the top wall 23 of the resonator 21 (not shown).

FIG. 4 shows a view of the resonator 21 with the top wall 22 removed.

The resonator 21 includes a drive shaft 29, which is arranged to be generally parallel with the top and bottom walls 22, 23. A connection end 30 of the drive shaft 29 protrudes from the side wall 24 which is opposite the opening 28. A collar 31 preferably projects from the side wall 24 and surrounds the connection end 30 of the drive shaft 29.

Within the resonator 21 is a series of internal supporting walls 32. In the discussion below, several rotating shafts are mentioned, including the drive shaft 29. These rotating shafts are all mounted on bearings 33, and supported by the internal walls 32 and (where appropriate) the external side walls 24. However, the details of how each shaft is supported will not be explained in details, for the purposes of brevity.

A first toothed gear 34 is formed around, and rotates with, the drive shaft 29. On a first side, the first gear 34 meshes with a second toothed gear 35, which is displaced from the first toothed gear 34 in a direction generally parallel with the upper and lower walls 22, 23 of the resonator 21. The second toothed gear 35 meshes with a third toothed gear 36, which again is displaced from the second toothed gear 35 in a direction parallel with the top and bottom walls 22, 23. Connected to, and rotatable with, the third toothed gear 36 is a first driven shaft 37, which lies generally parallel with the drive shaft 29. In this embodiment, part of the first driven shaft 37 extends beside the apertures 26 that are formed through the top and bottom walls 22, 23.

Mounted on the first driven shaft 37 are two off-centre masses 38, which are constrained to rotate with the first driven shaft 37. In this embodiment, the off-centre masses 38 comprise respective solid metal masses which are formed to have a shape which is generally cylindrical, but with part of one side removed, so that the centre of gravity of the mass is displaced from the geometric centre of the cylindrical shape.

Two off-centre masses 38 are shown in FIG. 4, although in alternative embodiments only one off-centre mass may be provided, or indeed three or more may be provided. In the embodiment shown, the centres of mass of the off-centre masses 38 are displaced from the first driven shaft 37 in the same direction, and by the same amount.

On a second side, opposite the first side, the first toothed gear 34 meshes with a fourth toothed gear 39, which is displaced from the first toothed gear 34 in a direction which is generally parallel with the top and bottom walls 22, 23, but the fourth toothed gear 39 is displaced from the first toothed gear 34 in the direction which is generally opposite to that in which the second toothed gear 35 is displaced from the first toothed gear 34.

The fourth toothed gear 39 meshes with a fifth toothed gear 40, which is positioned generally below the fourth toothed gear 39.

The fifth toothed gear 40 meshes with a sixth toothed gear 41, which is generally level with the fourth toothed gear 39, and laterally displaced with respect thereto in a direction generally parallel with the top and bottom walls 22, 23. The fourth and sixth toothed gears 39, 41 do not touch or mesh with each other, and in the embodiment shown this is achieved by placing these toothed gears 39, 41 at different distances from the side wall 24 through which the drive shaft 29 passes. To accommodate this, the fifth toothed gear 40, which meshes with both the fourth and sixth toothed gears 39, 41, is wide enough to mesh with both of the gears 39, 41 without these gears 39, 41 touching each other.

Connected to, and constrained to rotate with, the sixth toothed gear 41 is second driven shaft 42, which in the depicted embodiment is of generally the same length as, and parallel with, the first driven shaft 37. The second driven shaft 42 extends past the aperture 26 formed through the top and bottom walls 22, 23, but on the other side of this aperture 26 from the first driven shaft 37. It will therefore be understood that the apertures 26 formed through the top and bottom walls 22, 23 lie between the first and second driven shafts 37, 42.

Provided on the second driven shaft 42 are two further off-centre weights 43. These off-centre weights 43 are generally identical to those provided on the first driven shaft 37.

Rotation of the drive shaft 29, and therefore the first toothed gear 34, leads to rotation through the second and third toothed gears 35, 36 of the first driven shaft 37 in a first direction, which will be the same as the direction in which the drive shaft 29 is driven.

By contrast, through the action of the fourth, fifth and sixth toothed gears 39, 40, 41, the second driven shaft 42 will be driven to rotate at the same rate but in the opposite direction to the drive shaft 29 and the first driven shaft 37.

To operate the resonator 21, a motor is attached, directly or indirectly, to the connection end 30 of the drive shaft 29. In preferred embodiments a hydraulic motor (not shown) may be connected to the drive shaft 29 to power rotation of the drive shaft 29, but any other suitable motor may be used.

As the drive shaft 29 rotates, the first and second driven shafts 37, 42 will also rotate, in opposite directions. As this occurs, the action of rotating the off-centre weights 38, 43 on the first and second driven shafts 37, 42 will lead to vibration of the resonator 21 in the vertical direction (i.e. the direction generally parallel with a tubular passing through the lifting apparatus 20).

The skilled reader will understand that, because of the rotation of the first and second driven shafts 37, 42 in opposite directions, and the matching properties of the off-centre weights 38, 43, lateral vibrational movement (i.e. at right angles to the drive shaft 29, and parallel with the top and bottom walls 22, 23) will be entirely or substantially cancelled out.

The positioning of the first and second driven shafts 37, 42 on either side of the apertures 26 allows the space within the resonator 21 to be used efficiently, and also allows the vibrational forces produced by the resonator 21 to be balanced with respect to a tubular passing through the resonator 21, i.e. not to produce a pronounced effect on one side of the tubular more than another.

The upper spider is attached to, or supported by, the top plate 23 of the resonator 21, so that vibrations in the vertical direction produced thereby will be transmitted to a tubular which is held by the lifting apparatus 20. As is known in the art, when lifting or jacking tubulars from a wellbore, it is common for tubulars to be stuck, and to prevent very strong resistance to lifting. It is known that the application of strong vibrational motion to the tubulars in a direction generally parallel with the length of the tubulars is effective in freeing the tubulars, by dislodging the tubulars from obstructions and/or by fluidising obstructing material around the tubulars.

When applying vibrations, it is advantageous to apply vibrations at a frequency which generally matches the resonant frequency of the tubulars forming the drill string. In use of the resonator 21, the vibrations may firstly be applied at a frequency which is estimated to be around the resonant frequency of the tubulars forming the drill string. The frequency of vibrations is, as will be understood, set by the speed of which the drive shaft is rotated by the motor. The frequency can then be varied until the correct resonant frequency is found. The resonant frequency may be identified through the vibrations detected in the tubular held by the lifting apparatus 20. In particular, a strong resonant response at the driving frequency will be displayed, as well as smaller peaks of resonance at harmonics of this frequency. By contrast, when the tubulars are vibrated at a frequency which is removed from the correct resonant frequency, no strong resonant response will be observed, and significant quantity of background "noise" of vibrations and other frequencies will be present.

In use of the second lifting apparatus 20, a drill string may be lifted as described above, without the resonator 21 being activated, until significant resistance is encountered to upward pulling of the drill string. At this stage, the resonator 21 may be activated to dislodge the drill string and allow further upward pulling of the drill string to continue. It is then anticipated that the resonator 21 may be activated while the drill string is held under tension, i.e. the tubular passing through the lifting apparatus 20 is gripped by the upper spider, which is preferably located on top, and more preferably directly on top, of the resonator 21, and the hydraulic cylinders 9 are extended upwardly by a set distance. This will exert a lifting force (proportional to the pressure exerted on the cylinder pistons 12) on the tubular passing through the second lifting apparatus 20, and hence on the remainder of the drill string above the sticking point/obstruction. It is preferred not to extend the cylinders 9 by the maximum possible distance, as this may lead of excessive vibration and potentially damage to equipment. The resonator 21 is then activated (it is generally preferable not to activate the resonator 21 while the cylinders 9 are being extended or retracted), to apply longitudinal vibrational forces to the drill string, preferably at or around the resonant frequency of the drill string. This may continue until the lifting apparatus 20 is once again able to lift the drill string upwardly, indicating that the drill string has been dislodged from the obstruction that was previously preventing upward movement.

Depending on the type of obstruction, the resonator 21 may need to be activated for a period of minutes, tens of minutes or possibly an hour or more.

Referring to FIGS. 5 and 6, a third lifting apparatus 44 is shown.

In common with the second lifting apparatus 20, the third lifting apparatus 44 has bottom and top plates 2, 15, and a resonator 21 mounted on the upper surface of the top plate 15. The details of these components are unchanged compared to the second lifting apparatus 20.

In this example, instead of three separate hydraulic cylinders, an arcuate hydraulic drive arrangement 45 is provided between the lower and upper support plates 2, 15. The arcuate hydraulic drive arrangement 45 comprises a barrel 46 with a piston 47 slideably mounted therein. The cross-sectional shape of the piston is arcuate and takes the form of a part of an annulus. In preferred embodiments, the cross-sectional shape of the piston 47 comprises more than half a full ring, and may extend around 200-220° of a full circle.

At its free edges, the cross-sectional shape of the piston 47 may have a rounded profile.

In preferred embodiments the cross-sectional shape of the piston 47 remains substantially constant along its length.

The barrel 46 has an internal cross-sectional shape which closely matches the external cross-sectional shape of the piston 47. As will be understood by those skilled in the art, the piston 47 may be almost fully received in the barrel 46, and when pressurised hydraulic fluid is introduced into the chamber formed by the barrel 46, the piston 47 may be driven outwardly from the barrel 46. The arcuate hydraulic arrangement 45 effectively operates in the same manner as a regular hydraulic cylinder, but has an arcuate cross-sectional shape rather than a circular cross-sectional shape.

The arcuate hydraulic arrangement 45 is preferably positioned so that the centre of its curvature lies on or near a line connecting the centres of the central apertures 6, 48 of the lower and upper support plates 2, 15. The arcuate hydraulic arrangement 45 therefore generally surrounds a tubular held by the lifting apparatus 44. Preferably, the open side of the arcuate hydraulic arrangement 45 is aligned or substantially aligned with the gaps 5, 16 formed in the lower and upper support plates 2, 15.

At its upper end, the piston 47 has an arcuate piston head (not shown) which is attached to the underside of the top plate 15.

In use of the third lifting apparatus 44, the arcuate hydraulic arrangement 45 replaces the three hydraulic cylinders 9 that appear in the first and second lifting apparatuses 1, 20.

The majority of conventional lifting apparatuses include four hydraulic cylinders, which are generally radially evenly spaced. In embodiments of the present invention, it is desirable to have as much access as possible to the side of a tubular supported by the lifting apparatus. This is, as discussed above, so that operators can remove cables and the like from the exterior surface of the tubular, and also so that the tubular can be removed through the gaps 5, 16 in the lower and upper support plates 2, 15 if necessary.

For this reason, the first and second lifting apparatuses 1, 20 discussed above have only three hydraulic cylinders 9, rather than four.

The skilled reader will appreciate, however, that the overall lifting power generated by these three hydraulic cylinders will be less than would be the case if four cylinders were provided. While it would be possible to increase the size of each cylinder to compensate for this, increasing the sizes of the cylinders may be insufficient to compensate for this lost lifting power.

The arcuate lifting arrangement 45 shown in FIG. 5 helps to produce large lifting forces while still allowing easy access to a side surface of a tubular supported by the third lifting apparatus 44. The lifting force generated by a hydraulic cylinder is proportional to the cross-sectional area of the piston. Providing a hydraulic lifting arrangement which is arcuate and extends continuously around parts of the lower and upper support plates 2, 15 means that the cross-sectional area of the piston can be maximised while still allowing one side of the third lifting apparatus 44 to be open to allow access to the side of a tubular.

In yet further embodiments of the invention, a lifting arrangement that is not hydraulic can be used, such as gas cylinders or the like. Also, rack-and-pinion or other drive systems that are not fluid-operated can be used.

In embodiments of the invention, a rotation arrangement may be positioned between the upper support plate and the upper clamping arrangement, so that the upper clamping arrangement is rotatable with respect to the upper support plate. The rotation arrangement may be positioned directly on top of the support plate, or may be attached to one or more other components that are themselves attached to the upper support plate. The rotation arrangement allows rotation of the upper clamping arrangement, with respect to the upper support plate, around an axis which is aligned or substantially aligned with the longitudinal axis of a tubular component passing through the central aperture of the upper support plate.

The rotation arrangement preferably comprises a bearing. Conveniently, the bearing has a central aperture passing therethrough, which is aligned with the central aperture of the upper support plate and also of the aperture passing through the upper clamping arrangement. This means that a tubular passing through the upper support plate and the upper clamping arrangement will also pass through the bearing.

In these embodiments, if a tubular has been raised up sufficiently to be gripped by the upper clamping arrangement, the lower clamping arrangement can be placed in the open position, and the tubular may then be rotated (by way of the bearing) around its longitudinal axis with respect to the lifting apparatus. The skilled reader will appreciate that this will be advantageous in several ways. For instance, the component gripped by the upper support plate may be unscrewed from the next-lowest component by rotating the upper clamping arrangement, to release cooperating screw threads between the component gripped by the upper support plate and the next-lowest component.

Also, a component gripped by the upper clamping arrangement may be rotated, so that an operator may access a desired side of the component. For instance, the operator may need to release a clamp which holds cables against the side surface of a tubular. As the tubular is raised by the lifting apparatus, the side of the clamp that needs to be accessed to release the clamp may be facing away from the operator. If the operator can rotate the tubular so that the appropriate side of the clamp is facing towards him/her, releasing the clamp will be much easier.

If the lifting apparatus includes a resonator, then preferably the rotation arrangement is located above the resonator, and below the upper clamping arrangement.

As mentioned above, the rotation arrangement may comprise a bearing. The bearing may be generally circular in configuration, i.e. describe a fully closed circle. In this case, it will be necessary to remove the bearing before a tubular can be removed laterally from the lifting apparatus, as a part of the bearing will impede the lateral movement of the tubular. The tubular will otherwise need to be removed by lifting it upwardly through a sufficient distance that it is completely removed from the lifting apparatus.

Alternatively, a break may be formed in the bearing, which is (or can be) aligned with the gap in the upper support plate, and the skilled reader will understand how this can be achieved. In yet further embodiments, the rotation arrangement may comprise a plurality of spaced-apart bearing elements, which may for example be arranged on the top surface of the upper support plate at equally-spaced intervals around the central aperture. In these embodiments, again the gap formed in the upper support plate may be unimpeded, so that a tubular may be removed laterally from the lifting apparatus without the need to remove the rotation arrangement.

When rotation of the upper clamping arrangement is not required, it is envisaged that the upper clamping arrangement will be rotationally locked in place, to avoid unwanted or uncontrolled rotation of a component held by the upper clamping arrangements.

In further embodiments, a rotation arrangement such as a bearing (as described above) may be provided between the lower support plate and the lower clamping arrangement. This will, as will be understood from the above discussion, allow a tubular or other component that is held by the lower clamping arrangement to be rotated with respect to the lower support plate, so that it can, for example, be inspected, worked on or unscrewed from a component immediately above. Each of the types of rotation arrangement/bearing discussed above in connection with the upper clamping arrangement may also be used in connection with the lower arrangement.

In some embodiments, rotation arrangements may be provided at both the upper and lower clamping arrangements, and these can be used selectively as required.

A principal advantage of lifting apparatuses/jacking assemblies embodying the present invention is that they can be installed for use, easily and quickly, at any time. A conventional lifting apparatus must be hoisted up and threaded/stripped over the free end of the tubular component. If, for instance, the tubular component is stuck in the wellbore, it is not possible to drop the tubular downwardly to reduce the height of the top end of the tubular component. The tubular component will generally be supported by an overhead rig or top drive, and the connections between the rig/top drive and the tubular component will be in the way of this operation. These connections must be removed, while the weight of the tubular component/drill string is supported by other means. While these connections are removed and/or reconnected, the weight of the lifting apparatus must be supported by a sling or similar. It is also likely to be necessary to move or remove other components to allow sufficient space for the installation operation. If a conventional lifting apparatus needs to be installed around a tubular at short notice, the operation can take a few hours at a minimum, and may possibly take a full day or more, and the installation operation will be disruptive and labour-intensive.

By contrast, regardless of the position of a tubular component which is protruding from a wellbore, a lifting apparatus embodying the invention can be moved onto the tubular component in a lateral direction, and this is expected to take only minutes to accomplish. Circulation in the wellbore does not need to be stopped or interrupted, and (crucially) a rig or top drive positioned above the wellbore does not need to be disconnected or interfered with. The lifting apparatus is simply manoeuvred onto the side of the tubular component, with the tubular component passing through the gaps in the sides of the support plates (and other components of the lifting apparatus, as appropriate). This is relatively quick and simple, and also the safety risks involved will be significantly reduced. Likewise, removal of the lifting apparatus once it is no longer needed will be quick and simple.

A further advantage of lifting apparatuses embodying the present invention is that circulation of well fluid/drilling fluid does not need to be stopped for the apparatuses to be used. Lifting apparatuses embodying the invention can therefore be used during operations where circulation is needed, and one example is "fishing" operations, which may be done in conjunction with well jars. Well jars may be "cocked" (i.e. loaded with tension) by compression or extension of a drill or completion string, and then released to generate shock waves. Circulation of fluid is usually needed to clear debris or other materials generated by the operation of the jars, and lifting apparatuses embodying the invention can be used to apply tension/compression to a drill/completion string for an operation of this kind without interrupting the circulation of fluid when it is needed.

It should also be noted that rack and pinion style automated service rigs, which have been introduced relatively recently, cannot withstand a jarring shock load due to gear mesh rather than drilling line suspension. By contrast, lifting apparatuses embodying the present invention are capable of cocking and firing jars and absorbing any resulting shock waves or impacts.

In the embodiments described above, the hydraulic cylinders (or other lifting arrangement) are located entirely between the lower and upper support plates.

This does not need to be the case in all embodiments, however. For instance, in other embodiments the barrels of the cylinders may be above the upper support plate, or below the lower support plate, with the pistons projecting into the space between the upper and lower support plates through apertures formed in the upper or lower support plate (as appropriate). The movement of the pistons within the barrels therefore allows the distance between the upper and lower support plates to be varied. Embodiments of this kind will allow the minimum distance between the upper and lower support plates to be much lower, since the barrels of the cylinders do not need to be accommodated between the support plates. The lifting apparatus may also be able to perform a longer overall stroke.

It will be appreciated that lifting apparatuses embodying the present invention may be advantageous for the lifting/jacking drill string components, particularly where communication cables are present on the exterior of the components, and/or removal of the lifting apparatus from the drill string at short notice is required.

The discussion above uses the lifting of a drill string as an example. However, it should be understood that the apparatuses and methods disclosed herein may be used in other circumstances, for instance in completion, workover, remedial and/or abandonment phases of operation on a wellbore. The skilled reader will therefore understand that, where the description above makes reference to a drill string, the invention may equally find utility with, for example, a completion string.

The invention is also not limited to use with wells for oil or gas extraction, and may be used with, for example, water wells. Apparatuses and methods disclosed in this document may be used in conjunction with any type of bore that is formed or worked on, where elongate tubular components are inserted into and/or removed from the bore. This may include the driving/removal of piles for structures, including both land-based buildings and offshore structures and platforms, and also other procedures carried out in the marine and construction industries.

It is expected that lifting apparatuses as described herein will find most frequent use when tubulars and other components cannot be lifted from a wellbore by a regular drilling rig or derrick. A drilling rig may be able to lift tubulars up through large distances in one action, whereas lifting apparatuses of the kind described herein will be able to lift a tubular through only a relatively short distance (e.g. 4-6 ft) with each stroke. Using the drilling rig will therefore be preferable where this is possible, since using the drilling rig will be faster. However, it is expected that lifting apparatuses of this kind will be able to lift greater weights than some drilling rigs. The lifting apparatuses may therefore be used at the start of a lifting procedure, when the weight of a drill string or completion string is at its maximum, and the drilling rig will take over when the weight of the drill string/completion string is sufficiently reduced.

Also, when a drill string/completion string is stuck in the wellbore, the lifting force needed to raise the drill string/completion string may be higher than can be applied by the drilling rig, and so the lifting apparatus may be used until the drill string/completion string has been freed, at which point the drilling rig can be used again.

In other circumstances, a drilling rig may not be available, for instance in work carried out in a remedial or abandonment phase of a wellbore. In this case, the lifting apparatus may be used in isolation for the entire lifting operation.

The skilled reader will be aware of other circumstances in which the lifting apparatus will find utility.

In the discussion above, reference is made to upper and lower support plates. While it is expected that these components will have a generally plate-like form, this need not be the case and these components may have any suitable shape or configuration.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A lifting apparatus for lifting drill string components from a wellbore, the lifting apparatus comprising:

upper and lower support elements, each of the support elements having a central aperture passing therethrough;

a lifting arrangement which is operable to vary the distance between the upper and lower support elements between a first, relatively short distance and a second, relatively long distance; and selective gripping arrangements held or supported by the upper and lower support elements, respectively, each selective gripping arrangement being operable to apply a gripping force to the exterior of a substantially tubular element passing through the central apertures of the upper and lower support elements, wherein the selective gripping arrangements may be activated or deactivated independently of one another to jack a drill string, and wherein the selective gripping arrangements each comprise a set of slips, in the form of a tapered bowl which is narrower at its bottom end than at the top end, with gripping elements provided on the interior of the bowl to grip the outer surface of a tubular passing therethrough, each of which can be opened so that a substantially tubular element can be removed laterally therefrom, wherein the upper and lower support elements each have an inner surface defining the central aperture, and an outer surface, and a slot passing through the entire depth of the element and providing communication between the inner surface and the outer surface, and wherein the central apertures of the upper and lower support elements are at least partially aligned with one another, and the slots of the upper and lower support elements are at least partially aligned with one another, wherein the selective gripping arrangement held by the upper support element may be placed in a closed position, so that it grips an outer surface of the substantially tubular element and supports the substantially tubular element, and while the selective gripping arrangement held by the upper support element is in the closed position, the selective gripping arrangement held by the lower support element may be placed in an open position so that cables can be removed from a side of the substantially tubular element through the slot of the lower support element.

2. A lifting apparatus according to claim 1, wherein the lifting arrangement is a hydraulic lifting arrangement.

3. A lifting apparatus according to claim 2, wherein the lifting arrangement comprises one or more hydraulic cylinders.

4. A lifting apparatus according to claim 1, further comprising a resonator which is mounted on or attached to the upper support element.

5. A lifting apparatus according to claim 4, wherein the resonator has a central aperture formed therethrough, which allows a tubular element to pass entirely through the resonator.

6. A lifting apparatus according to claim 5, wherein the resonator has a slot formed therein passing from the central aperture of the resonator to a side wall thereof, allowing a tubular element passing through the central aperture of the resonator to be removed from the resonator entirely through the slot.

7. An apparatus according to claim 5, wherein the resonator is operable to apply vibrational forces acting substantially in a direction passing from the upper support element to the lower support element.

8. A lifting arrangement according to-claim 4, wherein a rotation arrangement is located between the resonator and the gripping arrangement.

9. A lifting apparatus according to claim 1, further comprising a rotation arrangement disposed between the upper support element and the gripping arrangement that is held or supported by the upper support element, so that the gripping arrangement is able to rotate with respect to the upper support element.

10. A lifting apparatus according to claim 9, wherein the gripping arrangement may rotate with respect to the upper support element around an axis that is substantially perpendicular to the plane of the upper support element.

11. A lifting arrangement according to claim 9, wherein the rotation arrangement has a gap formed therein so that a tubular element passing through the upper support element and the gripping arrangement may be removed from the lifting arrangement in a direction which is substantially parallel with the plane of the upper support element, and pass through the gap formed in the rotation arrangement as it is removed.

12. A lifting apparatus according to claim 1, further comprising a rotation arrangement disposed between the lower support element and the gripping arrangement that is held or supported by the lower support element, so that the gripping arrangement is able to rotate with respect to the lower support element.

13. A lifting apparatus according to claim 12, wherein the gripping arrangement may rotate with respect to the lower support element around an axis that is substantially perpendicular to the plane of the lower support element.

14. A lifting arrangement according to claim 12, wherein the rotation arrangement has a gap formed therein so that a tubular element passing through the lower support element and the gripping arrangement may be removed from the lifting arrangement in a direction which is substantially parallel with the plane of the lower support element, and pass through the gap formed in the rotation arrangement as it is removed.

15. A lifting apparatus for lifting drill string components from a wellbore, the lifting apparatus comprising:

upper and lower support elements, each of the support elements having a central aperture passing therethrough;

a hydraulic lifting arrangement which is operable to vary the distance between the upper and lower support elements between a first, relatively short distance and a second, relatively long distance; and selective gripping arrangements held or supported by the upper and lower support elements, respectively, each selective gripping arrangement being operable to apply a gripping force to the exterior of a substantially tubular element passing through the central apertures of the upper and lower support elements, wherein the selective gripping arrangements may be activated or deactivated independently of one another, wherein the upper and lower support elements each have an inner surface defining the central aperture, and an outer surface, and a slot passing through the entire depth of the element and providing communication between the inner surface and the outer surface, and wherein the central apertures of the upper and lower support elements are at least partially aligned with one another, and the slots of the upper and lower support elements are at least partially aligned with one another, wherein the lifting arrangement comprises an arcuate hydraulic lifting arrangement, comprising an arcuate piston slideably mounted within an arcuate barrel.

16. A lifting arrangement according to claim 15, wherein the arcuate lifting arrangement extends more than 180° around the central apertures of the upper and lower support elements.

17. A method comprising:

providing a lifting apparatus according to claim 1;

passing a substantially tubular element through the central apertures of the upper and lower support elements, so that the substantially tubular element extends continuously through the central apertures of the upper and lower support elements; and removing the substantially tubular element from the lifting apparatus in a generally lateral direction by passing the substantially tubular element through the slots of the upper and lower support elements so that the substantially tubular element is entirely removed from the lifting apparatus.

18. A method comprising:

providing a lifting apparatus according to claim 1;

installing the lifting apparatus around a substantially tubular element by moving the lifting apparatus towards the substantially tubular element in a generally lateral direction, so that the substantially tubular element passes through the slots of the upper and lower support elements, with the result that the substantially tubular element passes through the central apertures of the upper and lower support elements.

19. A method comprising:

providing a lifting apparatus according to claim 1;

passing a substantially tubular element through the central apertures of the upper and lower support elements, so that the substantially tubular element extends continuously through the central apertures of the upper and lower support elements;

gripping the substantially tubular element with one or both of the gripping arrangements; and operating the lifting arrangement to apply a force to the substantially tubular element in a direction substantially parallel with the longitudinal axis of the substantially tubular element.

20. A method comprising:

providing a lifting apparatus according to claim 9;

passing a substantially tubular element through the central aperture of the upper support element;

gripping the substantially tubular element using the gripping element that is held or supported by the lower or upper support element; and rotating the substantially tubular element, by way of the rotation arrangement, with respect to the upper and lower support elements, about an axis which is substantially parallel with the longitudinal axis of the substantially tubular element.

* * * * *